US006679630B2

(12) United States Patent
Knoerzer et al.

(10) Patent No.: US 6,679,630 B2
(45) Date of Patent: Jan. 20, 2004

(54) SELF-STANDING PACKAGE AND METHOD FOR MAKING THE SAME

(75) Inventors: Anthony Robert Knoerzer, Plano, TX (US); Garrett William Kohl, Allen, TX (US); Steven Kenneth Tucker, Hurst, TX (US)

(73) Assignee: Recot, Inc., Pleasanton, CA (US)

( * ) Notice: Subject to any disclaimer, the term of this patent is extended or adjusted under 35 U.S.C. 154(b) by 0 days.

(21) Appl. No.: 10/113,241

(22) Filed: Apr. 1, 2002

(65) Prior Publication Data

US 2003/0185469 A1 Oct. 2, 2003

(51) Int. Cl.[7] ..... B65D 30/16
(52) U.S. Cl. ..... 383/104; 383/120; 383/122
(58) Field of Search ..... 383/104, 120, 383/122; 206/525; 53/474, 410

(56) References Cited

U.S. PATENT DOCUMENTS

| | | | | |
|---|---|---|---|---|
| 2,153,846 A | | 4/1939 | Russell et al. | |
| 2,718,105 A | * | 9/1955 | Ferguson | 383/104 |
| 2,978,853 A | * | 4/1961 | Price | 53/546 |
| 3,315,801 A | * | 4/1967 | Lowry | 383/104 |
| 3,390,507 A | * | 7/1968 | Repko | 53/474 |
| 3,508,374 A | * | 4/1970 | Bertoglio | 383/122 |
| 3,785,546 A | * | 1/1974 | Kuster | 383/104 |
| 4,361,235 A | | 11/1982 | Gautier | |
| 4,526,566 A | | 7/1985 | Briand | |
| 4,563,231 A | | 1/1986 | Porrmann et al. | |
| 4,756,628 A | * | 7/1988 | Branson | 383/120 |
| 4,886,373 A | * | 12/1989 | Corella | 383/104 |
| 4,904,093 A | * | 2/1990 | Woods et al. | 383/122 |
| 5,265,961 A | * | 11/1993 | Boyd | 383/104 |
| 6,164,822 A | * | 12/2000 | Beer | 383/104 |

FOREIGN PATENT DOCUMENTS

JP 2191159 * 2/1990

* cited by examiner

*Primary Examiner*—John Sipos
(74) *Attorney, Agent, or Firm*—Colin P. Cahoon; Carstens, Yee & Cahoon, L.L.P.

(57) ABSTRACT

A flexible self-standing package and method for making the same provides for a package that has its own support mechanism. Thereby, a package, such as a snack food package, can be displayed in an upright position without the need to be placed against another package or wall. To achieve this, the package is formed with a support flap formed extended away from the tube of the package. When the package is positioned to stand, a pocket forms between the support flap and tube of the package to provide support.

14 Claims, 2 Drawing Sheets

SELF-STANDING PACKAGE AND METHOD FOR MAKING THE SAME

BACKGROUND OF THE INVENTION

1. Technical Field

The present invention relates to flexible packages, and the method for making same. More particularly, the present invention relates to flexible packages, and the method for making the same that are self-standing. The invention allows for use of flexible packages that can be stood upright without the need to be placed against other objects.

2. Description of Related Art

Vertical form, fill, and seal packaging machines are commonly used in the snack food industry for forming, filling, and sealing bags of chips and other like products. Such packaging machines take a packaging film from a sheet roll and forms the film into a vertical tube around a product delivery cylinder. The vertical tube is vertically sealed along its length to form a back seal. The machine applies a pair of heat-sealing jaws or facings against the tube to form a transverse seal. This transverse seal acts as the top seal on the bag below and the bottom seal on the package being filled and formed above. The product to be packaged, such as potato chips, is dropped through the product delivery cylinder and formed tube and is held within the tube above the bottom transverse seal. After the package has been filled, the film tube is pushed downward to draw out another package length. A transverse seal is formed above the product, thus sealing it within the film tube and forming a package of product. The package below said transverse seal is separated from the rest of the film tube by cutting across the sealed area.

The packaging film used in such process is typically a composite polymer material produced by a film converter. For example, one prior art composite film used for packaging potato chips and like products is illustrated in FIG. 1*a*, which is a schematic of a cross-section of the film illustrating each individual substantive layer. FIG. 1*a* shows an inside, or product side, layer 16 which typically comprises metalized oriented polypropylene ("OPP") or metalized polyethylene terephtalate ("PET"). This is followed by a laminate layer 14, typically a polyethylene extrusion, and an ink or graphics layer 12. The ink layer 12 is typically used for the presentation of graphics that can be viewed through a transparent outside layer 10, which layer 10 is typically OPP or PET.

The prior art film composition shown in FIG. 1*a* is ideally suited for use on vertical form and fill machines for the packaging of food products. The metalized inside layer 16, which is usually metalized with a thin layer of aluminum, provides excellent barrier properties. The use of OPP or PET for the outside layer 10 and the inside layer 16 further makes it possible to heat seal any surface of the film to any other surface in forming either the transverse seals or back seal of a package.

Typical back seals formed using the film composition shown in FIG. 1*a* are illustrated in FIGS. 2 and 3. FIG. 2 is a schematic of a "lap seal" embodiment of a back seal being formed on a tube of film. FIG. 3 illustrates a "fin seal" embodiment of a back seal being formed on a tube of film.

With reference to FIG. 2, a portion of the inside metalized layer 26 is mated with a portion of the outside layer 20 in the area indicated by the arrows to form a lap seal. The seal in this area is accomplished by applying heat and pressure to the film in such area. The lap seal design shown in FIG. 2 insures that the product to be placed inside the formed package will be protected from the ink layer by the metalized inside layer 26.

The fin seal variation shown in FIG. 3 also provides that the product to be placed in the formed package will be protected from the ink layer by the metalized inside layer 36. Again, the outside layer 30 does not contact any product. In the embodiment shown in FIG. 3, however, the inside layer 36 is folded over and then sealed on itself in the area indicated by the arrows. Again, this seal is accomplished by the application of heat and pressure to the film in the area illustrated.

As noted, a benefit of both the prior art fin seal and lap seal design is the containment of the product in the package by a barrier layer (the metalized inside layer) that keeps ink and solvent levels in the package to a minimum. Ink and solvent levels in fatty food packages are frequently regulated to insure product safety. It may be desirable, however, to provide a graphics capability inside a package. This would allow for promotional information or coupons to be maintained inside the package and only accessible after the consumer has opened the package. For example, a promotional prize campaign could be offered with the prize announcements being maintained inside the package. Likewise, coupons offering product rebate rewards, promotional prize points, or discounts on products could be maintained within the sealed package.

One prior art method used to provide a graphics capability inside the package involves the use of a paper insert dropped with the product into the package during filling. When the consumer opens the package, the paper insert can be removed for viewing and use. This method has several drawbacks, however. The reliability of placing a single paper insert in each bag (by dropping the paper with a weighed amount of product) is a major consideration, particularly in small packages. A capacity issue is raised by the need to rent inserters to be used during the filling process. Foreign matter detectors are also frequently set off by the detection of the paper insert within the bag. The insertion of a piece of paper can raise the solvent level in the package beyond acceptable levels. All of the above greatly adds to the expense of each single package.

Another approach to providing graphics within the bag would involve the application of the graphics directly to the inside metalized layer 16 shown in FIG. 1*a*. The application of such graphics can be accomplished using an inkjet printer. However, this method likewise raises a capacity issue, since present technology converters produce packaging film at a speed of 1500 to 2000 feet per minute, while the capacity of present inkjet printer heads is approximately 300 feet per minute. Additional modification to converters must be made in order to keep the inkjet printing in register with the graphics formed by the ink layer 12. All of the above considerations again add to the cost of the package. In addition, the United States Food & Drug Administration does not presently allow for the use of an ink-carrying layer that comes into contact with a fatty food.

Another prior art approach to this issue is illustrated in FIG. 1*b*, which is again a schematic cross-section of a packaging film. As with the embodiment shown in FIG. 1*a*, the embodiment shown in FIG. 1*b* comprises an outside OPP layer 10 followed by an ink layer 12, a laminate layer 14, and a metalized OPP or PET layer 16. However, an additional laminate layer 14' is applied to the metalized layer 16 so that an additional ink layer 12' and OPP or PET layer 10' can be used as the new inside layer 10'. The use of the ink layers 12, 12' as the second to last layer on both the outside and inside of the package allows for a full graphics capability on both the outside and the inside of the film. The additional film, however, adds approximately sixty percent (60%) to the cost of the material when compared with the embodiment shown in FIG. 1*a*. Overall capacity is also cut in half, since the film must be run through a typical converter twice. Further, since the material is 60% thicker, it cannot be run on a vertical form and fill machine at speeds as high as that used to make packages out of the embodiment shown in FIG. 1*a*. This is because longer dwell times must be used to form all the seals involved. As with the inkjet printer solution, the embodiment shown in FIG. 2*a* also requires additional efforts to keep the inside graphics and outside graphics in registration. Importantly, the embodiment shown in FIG. 1*b* again places ink inside a functional barrier layer, the metalized layer 16, which is not presently permitted for direct contact with many foods by the United States Food & Drug Administration.

In addition to ink and solvent concerns with package construction, packages, particularly with snack foods, need to be displayed to consumers. These packages are usually displayed in markets in designated areas, such as a supermarket aisle. There, packages are typically aligned so as to stack up against other packages while they rest on a shelf. As consumers remove packages from the shelf, this leaves packages to on its side if not properly supported. To encourage consumer purchases, markets prefer to have their products at the end of the store shelves leaving any empty space behind the products. With prior art packages as described above, it is not possible to leave empty space behind the packages because the packages cannot support themselves as would a boxed or canned product. Therefore, the only solutions are to leave the prior art packages toward the back of the shelf or to design shelves that have minimal depth, both of which are undesirable.

Consequently, a need exists for a package construction and method that allows for self-standing packages. A self-standing package for snack foods would allow packages to be displayed more effectively to consumers at the end of shelves without the need for other packages or alternatives for support. Additionally, it would be beneficial to have such self-standing packages to be manufactured relatively inexpensively with materials already known in the prior art. It is further desirable for the self-standing package constructions whereby a separate compartment can be formed for placement of materials with graphics so as to avoid or, at least minimize, ink and solvent contact with food.

SUMMARY OF THE INVENTION

The proposed invention involves producing a package made from flexible film having a film body formed as a discrete package. A support flap for supporting the package in a standing position is extended forth from the film body wherein the film body and the support flap are produced from a continuous segment of film. Thereby, when the package is positioned to stand upright, the support flap is extended away from the body of the tube of the package forming a pocket there between for support.

The method for forming the self-standing package comprises forming a sheet of film into a tube with an over-lapped segment of film extending out from the tube to form a support flap. Thereafter, at least one seal axially along the support flap is provided. The package is finished by sealing both terminal ends of the tube and the support flap to form the self-standing flexible package. Optionally, a pocket can be formed within the support flap for placement of printed graphic materials or other product.

The above as well as additional features and advantages of the present invention will become apparent in the following written detailed description.

BRIEF DESCRIPTION OF THE DRAWINGS

The novel features believed characteristic of the invention are set forth in the appended claims. The invention itself, however, as well as a preferred mode of use, further objectives and advantages thereof, will be best understood by reference to the following detailed description of illustrative embodiments when read in conjunction with the accompanying drawings, wherein:

DETAILED DESCRIPTION

Figure 1A:
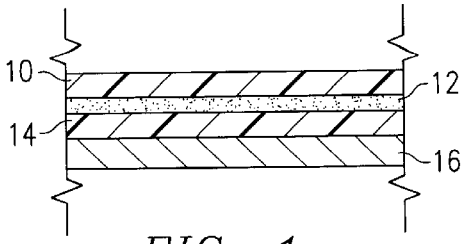
FIG. 1a (PRIOR ART)
FIGS. 1*a* and 1*b* are schematic cross-section views of prior art packaging films.
Figure 1B:
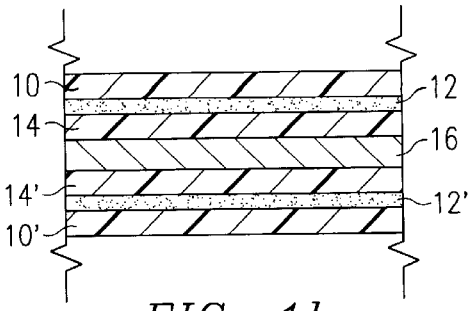
FIG. 1b (PRIOR ART)
Figure 2:
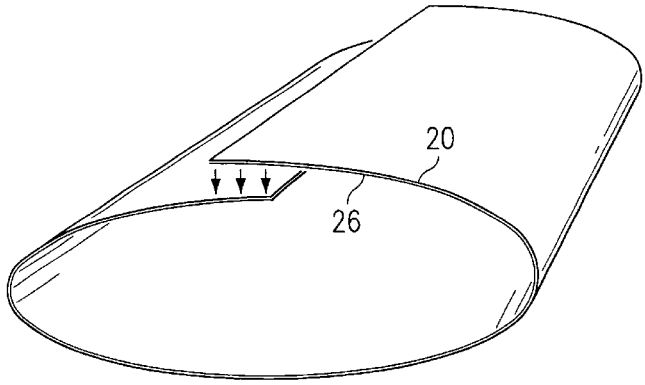
FIG. 2 (PRIOR ART)
FIG. 2 is a schematic cross-section view of a tube of packaging film illustrating the formation of a prior art lap seal.
Figure 3:
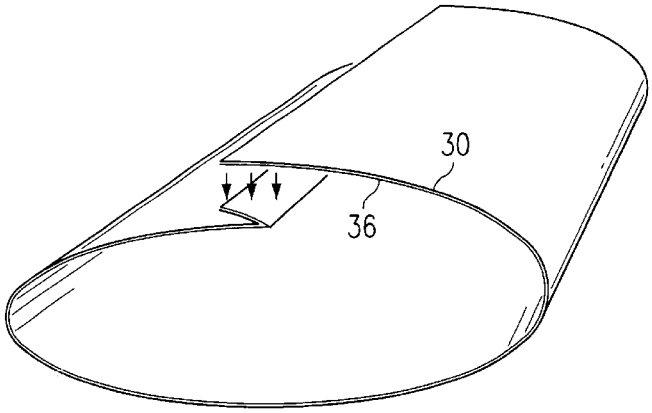
FIG. 3 (PRIOR ART)
FIG. 3 is a schematic cross-section of a tube of packaging film illustrating the formation of a prior art fin seal.
Figure 4:
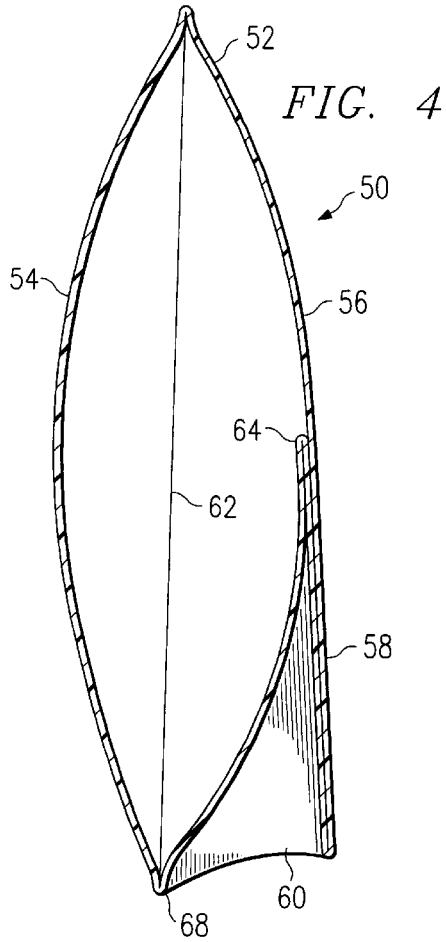
FIG. 4 is a cross-sectional view of a self-standing flexible package made in accordance with an embodiment of the invention wherein the support flap is sealed completely.

FIG. 4 shows a cross sectional view of a flexible package 50 for containing snack food products. The composition of the package material can be the same as used for prior art packaging as described in relation to FIG. 1*a* or any other prior art film composition used for the product application in the instant invention.

A film 52 used in the present invention is fed into a vertical or horizontal form, fill, and seal packaging machine capable of manufacturing a package in accordance with the invention. Thereby, package 50 is formed having a front 54 and a back 56. Since film 52 is a flat film, film 52 is fed into the packaging machine to generally form a cylinder. The leading end of the film is sealed to a trailing end of the same film to form a back seal 64 rendering the cylinder independent. Once package 50 is complete, a transverse end seal 62 can be formed at both ends of package 50.

Unlike the prior art though, back seal 64 is not merely a thin seal of overlapped film. Here, a flap 58 is formed of film 52. More particularly, flap 58 is formed, for example, by allowing terminal ends from a sheet of film 52 to extend outward and away from the formed cylinder. Back seal 64 can then be optionally formed longitudinally down the length of the tube. The length of back seal 64 can be varied. As shown in FIG. 4, back seal 64 extends down to the entire length of flap 58. However, other embodiments are possible.

To provide support, terminal portions of flap 58 are joined to transverse seals 62 that form the top and bottom seals of the discreet package 50. The transverse portion of flap 58 that is sealed to the top and bottom of package 50 forms end seals 68. An end seal 68 extends from the position where flap 58 begins to extend forth from package 50, for example, at a middle point on back 56, down to most outward portion of flap 58. Thereby, pocket 60 is formed between flap 58 and back 56 of the package. As package 50 is comprised of a flexible material, flap 58 will generally lie flush against back 56. However, when flap 58 is drawn away from back 56, pocket 60 becomes open as shown in FIG. 4. Once pocket 60 is opened, package 50 can be positioned to stand erect with the use of flap 58.

Figure 5:
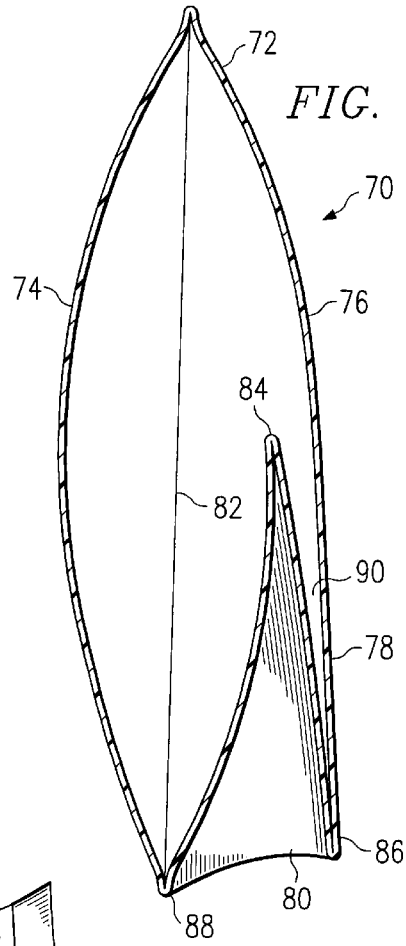
FIG. 5 is a cross-sectional view of a self-standing flexible package made in accordance with an embodiment of the invention wherein the support flap not sealed and is open to the body of the package.

In another embodiment, a cross sectional view of a package 70 is shown in FIG. 5 and is formed from flexible package material film 72. Similar to the formation of package 50, package 70 is formed having a front 74 and a back 76. A flap 78 is formed however without a back seal like that of back seal 64 on package 50.

Instead, flap 78 is formed by creating a bend 84 in film 72 to form the inner portion of flap 78. If needed, bend 84 can be treated to help retain its shape such as by heat or by sealing a small inner portion of flap 78 to back 76. Since no back seal is provided, an opening 90 is formed between the inner and outer portions of flap 78. This allows any product that is packaged within package 70 to be able to move into opening 90. Optionally, a seal 86 can be provided at the end of flap 78 to provide rigidity to flap 78. Seal 86 can be formed in either one or a few spots along the length of the terminal end of flap 78 or seal 86 can be formed down the entire length of the terminal end of flap 78.

To provide support to package 70, terminal portions of flap 78 are joined to transverse end seals 82 that form the top and bottom seals of the discreet package 70. The transverse portion of flap 78 that is sealed to the top and bottom of package 70 forms end seals 88. An end seal 88 extends from the position where flap 78 begins to extend forth from package 70, for example, at a middle point on back 76, down to most outward portion of flap 58. Thereby, pocket 80 is formed between flap 78 and back 76 of the package. As package 70 is comprised of a flexible material, flap 78 will generally lie flush against back 76. However, when flap 78 is drawn away from back 76, pocket 80 becomes open as shown in FIG. 5. Once pocket 80 is opened, package 70 can be positioned to stand erect with the use of flap 78.

Various options are available for the arrangement of flaps 58 and 78. While flaps 58 and 78 are shown having particular lengths, the length of the flaps in relation to the packaging need only be as long so as to be able to support packages 50 and 70 in standing positions. Particularly with flap 78, various sealing options are available. For example, a seal could be formed at bend 84 so as to create a back seal. However, the seal need not extend down through to the terminal end of flap 78. Thereby, an open space like opening 90 can be formed. Unlike package 70 though, the open space would be separate from any contents that would be placed into the package. This is beneficial in that printed material such as coupons, contest materials, or sample products can be provided without having to come into with any contents in the main portion of the package. With food products, this is particularly advantageous as the printed materials would not come into with it.

Figure 6:
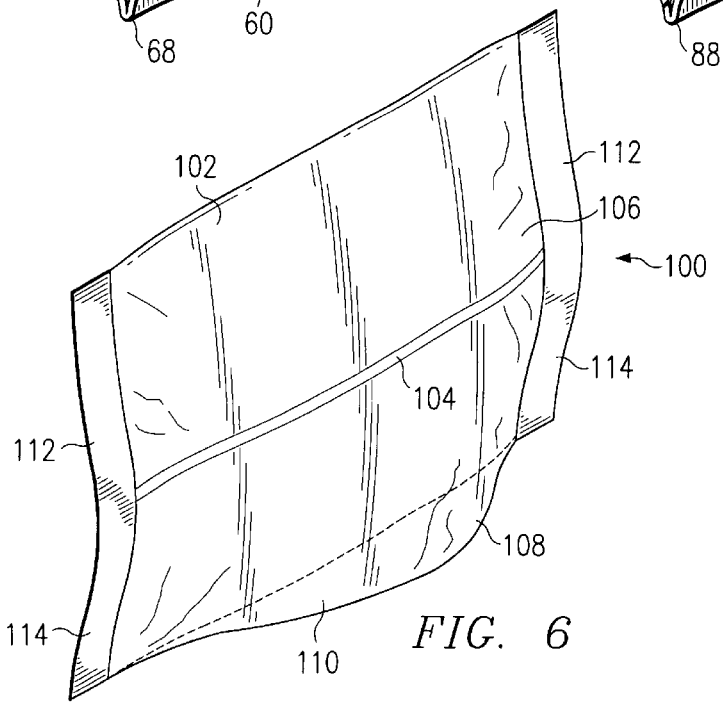
FIG. 6 is an elevational view of the back of the package of FIG. 4 having the package in a self-standing position.

FIG. 6 shows a completed package 100 in a standing or display position. Package 100 is formed from a flexible material film 102. Package 100 is of the design shown in FIG. 4 so a back seal 104 is formed along the back 106 to join together the ends of the tube of package 100. As package 100 is shown standing, flap 108 extends outward and away from back 106 forming pocket 110. To enclose and retain any product within the package, transverse end seals 112 seal the terminal ends of package 100. To retain flap 108 to the terminal ends of package 100, transverse seals 114 are provided. While package 100 is shown to appear wider than taller, this does not preclude other embodiments where a package could be formed taller than wider while in a standing position.

While the invention has been particularly shown and described with reference to a preferred embodiment, it will be understood by those skilled in the art that various changes in form and detail may be made therein without departing from the spirit and scope of the invention.

What is claimed is:

1. A self-standing flexible pouch, comprising:

a body having interior space and first and second transverse heat seals completely across said body; and a flap that is integrally formed with and extending away from said body, said flap having a plurality of layers bent away from said body and a first edge and a second edge that are formed as part of said first and said second transverse seals respectively and a seal that extends from said first transverse seal to close said interior space to said second transverse seal;

wherein said first transverse seal and said second transverse seal each seal all layers of said body and said flap together;

wherein said flap is of a size and configuration such that a portion of said flap between said first and said second transverse seals can be extended from said pouch to hold said pouch upright.

2. The self-standing flexible pouch of claim 1, wherein said pouch is formed from a single sheet of continuous film.

3. The self-standing flexible pouch of claim 1, wherein said flap rests against said body when not positioned to be self-standing.

4. The self-standing flexible pouch of claim 1, wherein a pocket is formed between said flap and said body when said pouch is positioned to be self-standing.

5. The self-standing flexible pouch of claim 1, wherein said flap is entirely formed of overlapped film.

6. The self-standing flexible pouch of claim 1, wherein said flap comprises a second back seal extending from said first transverse seal to said second transverse seal to form a separate compartment.

7. The self-standing flexible pouch of claim 6, wherein said separate compartment contains a printed graphic or food product.

8. The self-standing flexible pouch of claim 1, wherein said flap is open to the interior of said body.

9. The self-standing flexible pouch of claim 1, wherein said back seal extends across essentially all of said flap.

10. A self-standing flexible package, comprising:

a pouch having an interior space and a flap formed from a single sheet of flexible film and said flap extending away from said pouch and having a plurality of layers bent away from said pouch and a first heat seal extending across an edge of said pouch and said flap and sealing all layers of said pouch and said flap together and a second transverse heat seal extending across an opposite edge of said pouch and said flap and sealing all layers of said pouch and said flap together, said flap overlying a portion of said pouch;

wherein said flap contains a seal that extends between said first and said second transverse heat seals to close and interior space;

wherein said flap is of a size and configuration such that a portion of said flap between said first and said second transverse heat seals can be extended from said pouch to hold said pouch upright.

11. The self-standing flexible package of claim 10, wherein said back seal extends across essentially all of said flap.

12. The self-standing flexible package of claim 10, wherein said pouch and said flap are open to each other.

13. The self-standing flexible package of claim 10, wherein said clap further comprises a second back seal to form a separate compartment in said flap.

14. The self-standing flexible package of claim 3, wherein said separate compartment contains a printed graphic or a food product.

* * * * *

UNITED STATES PATENT AND TRADEMARK OFFICE

CERTIFICATE OF CORRECTION

PATENT NO. : 6,679,630 B2
DATED : January 20, 2004
INVENTOR(S) : Knoerzer et al.

It is certified that error appears in the above-identified patent and that said Letters Patent is hereby corrected as shown below:

Column 6,
Line 13, after "heat seals to close" delete "and" and insert -- said --

Signed and Sealed this

Fifteenth Day of June, 2004

JON W. DUDAS
*Acting Director of the United States Patent and Trademark Office*